US011692799B1

(12) United States Patent
Tasick

(10) Patent No.: US 11,692,799 B1
(45) Date of Patent: Jul. 4, 2023

(54) FIREWORK ASSEMBLY

(71) Applicant: George Tasick, Tacoma, WA (US)

(72) Inventor: George Tasick, Tacoma, WA (US)

( * ) Notice: Subject to any disclaimer, the term of this patent is extended or adjusted under 35 U.S.C. 154(b) by 0 days.

(21) Appl. No.: 17/551,157

(22) Filed: Dec. 14, 2021

(51) Int. Cl.
*F42B 4/20* (2006.01)

(52) U.S. Cl.
CPC ..... *F42B 4/20* (2013.01)

(58) Field of Classification Search
CPC ..... F42B 4/20; F42B 4/24; F42B 4/00; F42B 4/02; F42B 4/14; F42B 4/06; F42B 4/22; F42B 4/30; F42B 10/663; F42B 12/36; F42B 12/70; F42B 39/26; F42B 3/103; F42B 3/26; F42B 12/205; F42B 5/155; F42B 3/10; F42B 3/124; F42B 3/195
USPC ..... 102/335, 345, 352, 360
See application file for complete search history.

(56) References Cited

U.S. PATENT DOCUMENTS

| | | | | |
|---|---|---|---|---|
| 7,051,657 | B2 * | 5/2006 | Yi | C06C 5/06 102/275.7 |
| 7,562,627 | B2 * | 7/2009 | Voigt | F42B 4/24 102/342 |
| 2018/0106580 | A1 * | 4/2018 | Li | F42B 4/20 |
| 2019/0204049 | A1 * | 7/2019 | Deng | F42B 4/24 |

FOREIGN PATENT DOCUMENTS

WO WO-2018046072 A1 * 3/2018

* cited by examiner

*Primary Examiner* — John Cooper
(74) *Attorney, Agent, or Firm* — C. John Brannon; Brannon Sowers & Cracraft PC

(57) ABSTRACT

A multi-shot cake or aerial firework assembly, including a plurality of mortar tubes defining a firework assembly, wherein each respective mortar tube has a top end, an oppositely disposed bottom end, and a mortar tube length, and a plurality of shells, each respective shell disposed within a respective mortar tube. A first short tube having a first short tube length less than the mortar tube length is connected to the firework assembly, wherein the first short tube has a first short top end and a first short tube bottom end. A second short tube having a second short tube length less than the mortar tube length is connected to the firework assembly, wherein the second short tube has a second short tube top end and a second short tube bottom end. A fountain firework disposed within the second short tube for discharge through the second short tube top end. An elongated fuse having a proximal end and a distal end extends from the first short tube through each respective mortar tube and into the second short tube, wherein a sum of the first short tube length and the second short tube length together is less than the mortar tube length, and wherein the bottom end of the first short tube is elevated higher than the top end of the second short tube.

10 Claims, 3 Drawing Sheets

FIREWORK ASSEMBLY

TECHNICAL FIELD

This novel technology relates generally to the field of explosives, and, more particularly, to a cake firework assembly that may be ignited by non-contiguous identical cake firework assembly, and that may ignite another non-contiguous identical cake firework assembly.

BACKGROUND

Fireworks are a part of celebration culture and tradition going back thousands of years. In addition to the more common firecrackers, skyrockets, and sparklers, fireworks include fountains which shower sparks from the ground into the air, missiles, and mortars which are explosive shells propelled into the air from one or more tubes. Cakes are multiple mortar tubes connected by a fuse that when lit, fires the mortar shells in sequence.

Because fireworks by their explosive nature can be dangerous, they tend to be fairly tightly regulated. Cakes are regulated to have a maximum weight of 500 grams, such that 500 gram cakes are the most powerful multi-shot repeaters on the market. 500 grams is the maximum amount of pyrotechnic powder allowed in a multi-shot repeater. Further, if two cakes are physically connected, they are regulated as if they were a single cake.

Consumers tend to like firework cakes because each cake device lasts for a relatively long time and fires a few big shots or a lot of smaller ones. Cakes can offer a wide variety of different effects, including colors, sounds, and patterns. Consumers with bigger fireworks budgets gravitate towards cakes as they can be combined to put on a dazzling display. However, each cake must be lit individually, meaning the presenter must actively time the lighting of each firework, which keeps the presenter at ground zero in case of an accident and also deprives the presenter of the ability to sit back and enjoy the show.

Thus, there is a need for a cake design that would allow for an effective combining of cake devices while avoiding a direct physical connection of the same. The present novel technology addresses this need.

DETAILED DESCRIPTION

Figure 1:
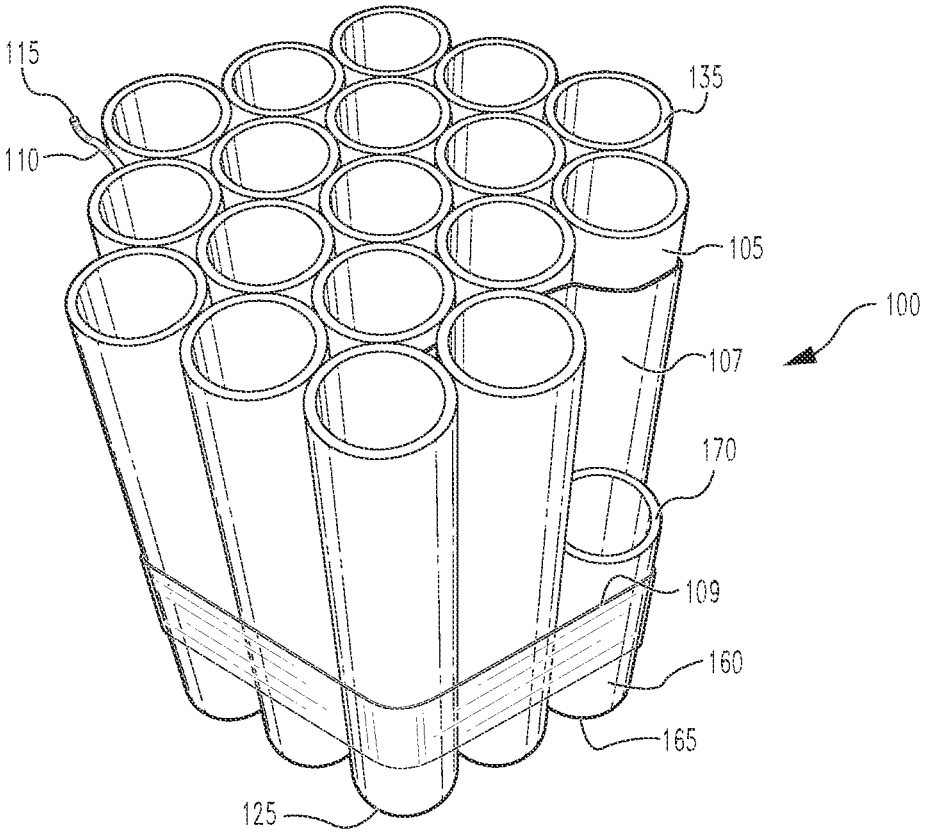
FIG. 1 is a first perspective view illustration of a cake-type firework apparatus.

For the purposes of promoting an understanding of the principles of the novel technology, reference will now be made to the embodiments illustrated in the drawings and specific language will be used to describe the same. It will nevertheless be understood that no limitation of the scope of the novel technology is thereby intended, such alterations and further modifications in the illustrated device, and such further applications of the principles of the novel technology as illustrated therein being contemplated as would normally occur to one skilled in the art to which the novel technology relates.

Figure 2:
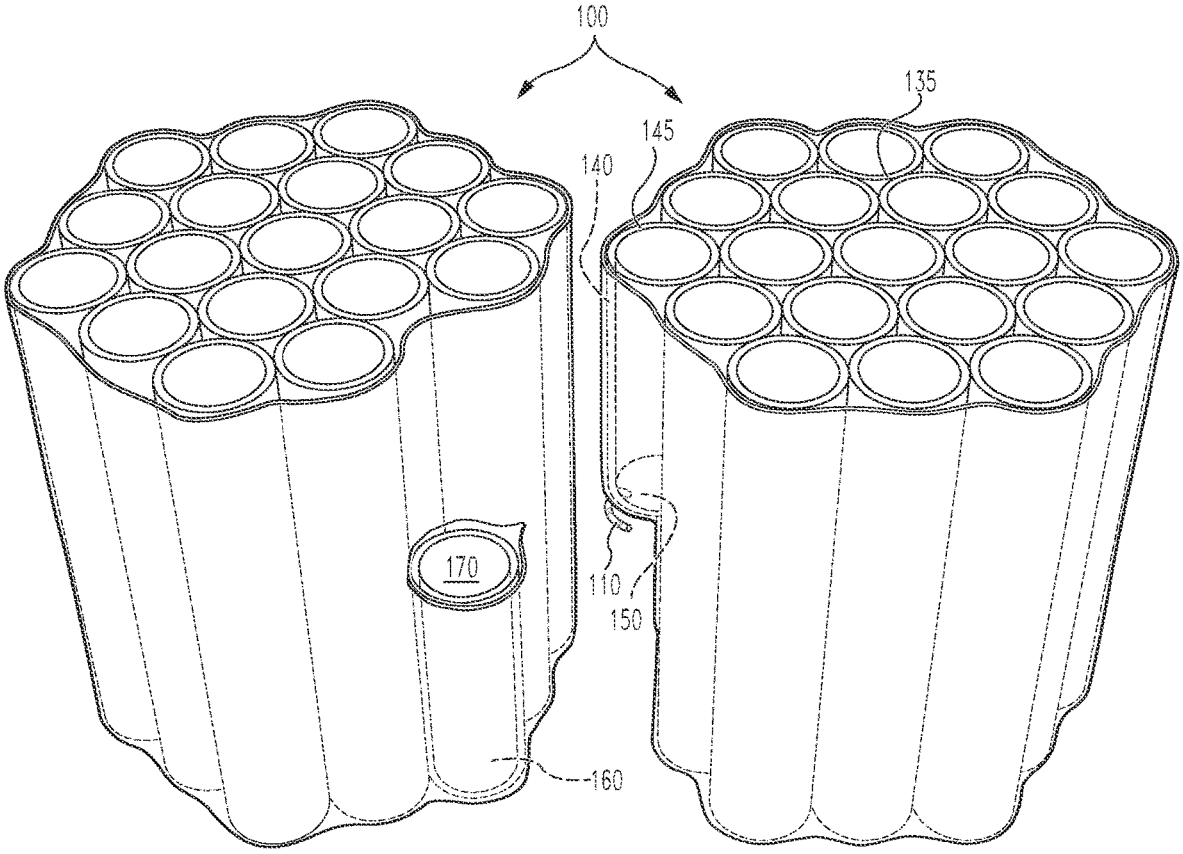
FIG. 2 is a perspective view illustration of a pair of cake-type firework apparati of FIG. 1.
Figure 3:
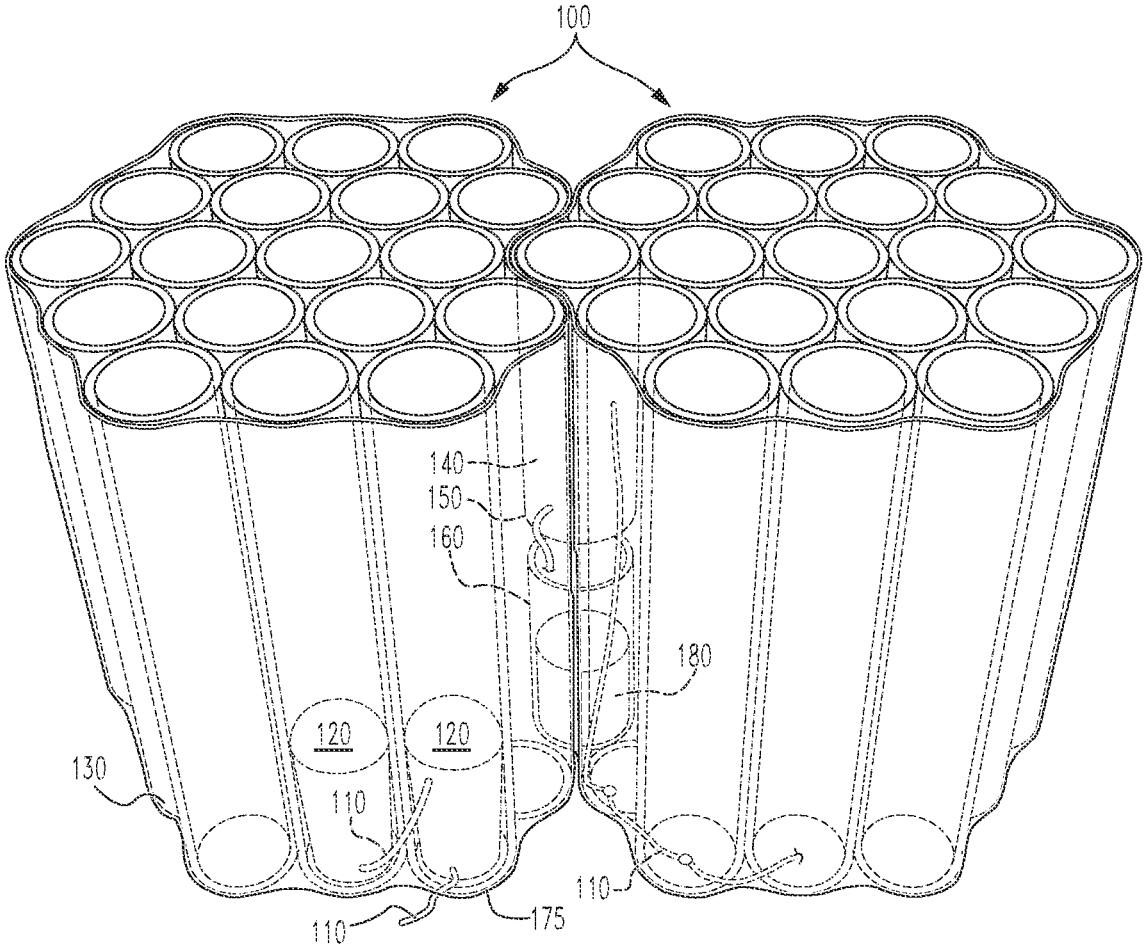
FIG. 3 is a partial cutaway illustration of the pair of cake-type firework apparati of FIG. 2 oriented to ignite sequentially.

FIGS. 1-3 illustrate a first embodiment of the present novel technology, a cake-type firework assembly 100 having a plurality of mortar tubes 105 positioned adjacent one another and connected together by a common fuse 110. The mortar tubes 105 are connected together structurally, either by direct connection or via intermediate structural members 107, such as boards, and/or flexible connection media 109, such as tape. The fuse 110 has an exposed proximal end 115 which may be lit to begin the firing sequence of the cake device 100, wherein mortar tubes 105 are sequentially ignited to fire their loads 120.

The mortar tubes 105 are typically all of equal length and dimension, and have bottom ends 125 resting on a flat member 130 or ground and have top ends 135 terminating flush with one another. The proximal end of the fuse 115 is connected to a first partial tube 140. The first partial tube 140 is positioned adjacent one or more mortar tubes 105 and has a top end 145 extending flus with the mortar top ends 135 and a bottom end 150 that terminates about midway between the top and bottom ends 135, 125. The fuse 110 extends into the bottom end 150 and from there extends sequentially to each mortar tube 105.

A second partial tube 160 is likewise connected to the assembly 100, this time having a bottom end 165 positioned flus with the bottom ends 125 and a top end 170 terminating below the bottom end 150 of the first partial tube 140. The first and second partial tubes 140, 160 are spaced from on another, such as positioned on opposite sides of the cake assembly 100. The fuse 110 has a distal end 175 that terminates in the second partial tube 160. The second partial tube 160 does not contain a mortar load, but instead contains a fountain-type firework 180. The second partial tube 160 is ignited last, after all of the mortar loads have been fired, and sprays a jet of flame and sparks upwardly from the top end 170.

When two similar or identical cake assemblies 100', 100" are positioned adjacent one another, the top end 170 of the second partial tube 160 of one assembly 100' may be positioned directly under the bottom end 150 of the first partial tube 140 of the other assembly 100" (without either assembly 100', 100" directly contacting or touching the other 100", 100'), such that when the first assembly 100' is ignited, its second partial tube 160 will sequentially fire and its fountain will extend into the bottom 150 of the first partial tube 140 of the second assembly 100", igniting its fuse 110 and thus initiating sequential firing of its mortar tubes 105. Any number of assemblies 100 may likewise be positioned, or 'chained', to sequentially fire after the first device 100 is ignited.

In some implementations, the cake device 100 may include a plurality of second partial tubes 160 connected thereto and spaced from one another. The fuse 110 is bifurcated such that all partial tubes 160 are connected to a distal end 175 and are ignited more or less simultaneously so as to ignite the first partial tubes 140 of additional cake devices 100 positioned above each respective partial tube 160.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A firework device, comprising:

a plurality of operationally connected mortar tubes defining a cake firework, wherein each respective mortar tube has a top end, an oppositely disposed bottom end, and a first length;

a first partial tube having a second length less than the first length and operationally connected to the cake firework, wherein the first partial tube has a first partial tube top end and a first partial tube bottom end;

a second partial tube having a third length less than the first length and operationally connected to the cake firework, wherein the second partial tube has a second partial tube top end and a second partial tube bottom end;

a fountain firework disposed within the second partial tube and oriented to discharge through the second partial tube top end;

a fuse having a proximal end and a distal end, wherein the fuse extends from the first partial tube, is operationally connected to each respective mortar tube, and terminates in the second partial tube;

wherein a sum of the second and third lengths is less than the first length;

wherein the proximal end is disposed within the first partial tube;

wherein the distal end is disposed within the second partial tube; and wherein the bottom end of the first partial tube is above the top end of the second partial tube; and wherein when two identical cake fireworks are positioned with respective first and second tubes a respective first partial tube aligned a respective second partial tube, said respective partial tubes remain physically separate and noncontiguous with one another.

2. The firework device of claim 1, and further comprising a flat support member contacting the respective bottom end of each respective mortar tube and the bottom end of the second partial tube.

3. The firework device of claim 1, wherein the respective bottom end of each respective mortar tube and the bottom end of the second partial tube are flush with one another.

4. The firework device of claim 1, wherein the respective top end of each respective mortar tube and the top end of the first partial tube are flush with one another.

5. A multi-shot aerial firework assembly, comprising:

a plurality of mortar tubes defining a pyrotechnic assembly, wherein each respective mortar tube has a top end, an oppositely disposed bottom end, and a mortar tube length;

a plurality of shells, each respective shell disposed within a respective mortar tube;

a first short tube having a first short tube length less than the mortar tube length and connected to the pyrotechnic assembly, wherein the first short tube has a first short top end and a first short tube bottom end;

a second short tube having a second short tube length less than the mortar tube length and connected to the pyrotechnic assembly, wherein the second short tube has a second short tube top end and a second short tube bottom end;

a fountain firework disposed within the second short tube for discharge through the second short tube top end;

an elongated fuse having a proximal end and a distal end, wherein the elongated fuse extends from the first short tube through each respective mortar tube and into the second short tube;

wherein a sum of the first short tube length and the second short tube length together is less than the mortar tube length; and wherein the bottom end of the first short tube is elevated higher than the top end of the second short tube.

6. The firework assembly of claim 5 wherein the proximal end is disposed within the first short tube; and wherein the distal end is disposed within the second short tube.

7. An assembly of non-contiguous pyrotechnic devices, comprising:

a first pyrotechnic device having a first plurality of operationally connected first mortar tubes, a first fuse operationally connected to at least one respective first mortar tube, and a first foreshortened mortar tube;

a second pyrotechnic device having a second plurality of operationally connected second mortar tubes, a second foreshortened mortar tube, and a second fuse operationally connected to the second foreshortened mortar tube;

wherein the first and second pyrotechnic devices are positionable to align the first and second foreshortened mortar tubes;

wherein when positioned with the first and second foreshortened mortar tubes in alignment, the first pyrotechnic device does not physically contact the second pyrotechnic device; and wherein the first foreshortened mortar tube is a fountain firework for spraying a jet of flame at the second fuse.

8. The assembly of non-contiguous pyrotechnic devices of claim 7 wherein the second pyrotechnic device further comprises a second foreshortened fountain firework.

9. The assembly of non-contiguous pyrotechnic devices of claim 8 and further comprising:

a third pyrotechnic device having a third plurality of operationally connected third mortar tubes, a third foreshortened mortar tube, and a third fuse operationally connected to the third foreshortened mortar tube;

wherein the second and third pyrotechnic devices are positionable to align the second foreshortened fountain firework and the third foreshortened mortar tube;

wherein when positioned with the second foreshortened fountain firework and the third foreshortened mortar tube in alignment, the second pyrotechnic device does not physically contact the third pyrotechnic device.

10. The assembly of non-contiguous pyrotechnic devices of claim 8 and further comprising:

a fourth pyrotechnic device having a fourth plurality of operationally connected fourth mortar tubes, a fourth foreshortened mortar tube, and a fourth fuse operationally connected to the fourth foreshortened mortar tube;

wherein the third and fourth pyrotechnic devices are positionable to align the third foreshortened fountain firework and the fourth foreshortened mortar tube;

wherein when positioned with the third foreshortened fountain firework and the fourth foreshortened mortar tube in alignment, the third pyrotechnic device does not physically contact the fourth pyrotechnic device.

* * * * *